US005736920A

United States Patent [19]

Evans et al.

[11] Patent Number: 5,736,920

[45] Date of Patent: Apr. 7, 1998

[54] MINIATURE FEMALE FUSE WITH LOW MELTING TEMPERATURE FUSIBLE LINK

[75] Inventors: Terence John Evans, Ballwin; Kenneth Alfred Berkbigler, Grover; Terry Lee Tiede, Ballwin, all of Mo.

[73] Assignee: Cooper Industries, Inc., Houston, Tex.

[21] Appl. No.: 597,917

[22] Filed: Feb. 7, 1996

[51] Int. Cl.[6] ..... H01H 85/02; H01H 85/06

[52] U.S. Cl. ..... 337/290; 337/197; 337/186

[58] Field of Search ..... 337/159, 160, 337/186, 197, 198, 227, 231, 290, 295

[56] References Cited

U.S. PATENT DOCUMENTS

| | | | |
|---|---|---|---|
| 4,224,592 | 9/1980 | Urani et al. . | |
| 4,293,836 | 10/1981 | Arikawa | 337/290 |
| 4,531,806 | 7/1985 | Hsieh . | |
| 4,570,147 | 2/1986 | Ebi | 337/166 |
| 4,646,052 | 2/1987 | Matsunaga et al. . | |
| 4,672,352 | 6/1987 | Takano . | |
| 4,800,358 | 1/1989 | Takenouchi et al. . | |
| 5,019,457 | 5/1991 | Nishio | 428/606 |
| 5,227,759 | 7/1993 | Hatagishi . | |
| 5,229,739 | 7/1993 | Oh et al. . | |
| 5,262,751 | 11/1993 | Kudo et al. | 337/296 |
| 5,293,147 | 3/1994 | Oh et al. . | |
| 5,416,461 | 5/1995 | Totsuka et al. | 337/261 |

*Primary Examiner*—Leo P. Picard
*Assistant Examiner*—Jayprakash N. Gandhi
*Attorney, Agent, or Firm*—Burns, Doane, Swecker & Mathis LLP

[57] ABSTRACT

A miniature female fuse includes a casing; a pair of clips inside the casing; and a fusible link electrically connecting the clips, the fusible link being constructed from a low temperature melting alloy such as Pb(82)/Sb(18), Sn(96.5)/Ag(3.5), or Au(80)/Sn(20).

15 Claims, 3 Drawing Sheets

MINIATURE FEMALE FUSE WITH LOW MELTING TEMPERATURE FUSIBLE LINK

FIELD OF THE INVENTION

The present invention relates to a miniature female fuse, and in particular to a miniature female fuse with a fusible link constructed from a low temperature melting alloy suitable for use in an automobile.

DISCUSSION OF RELATED ART

Prior art automotive fuses have been, for the most part, male, blade type fuses. Such fuses plug into fuse blocks which have metal spring clips and double female clips between the fuse blade and the bus bar. If the connection overheats, the spring clips will anneal, causing them to lose their flexibility. When this happens, not only must the fuse be replaced, but the fuse block must be disassembled to replace the clips. This is expensive and labor intensive. Furthermore, if it is the spring clip on the end of the wire that anneals, the wire must be replaced with its' clip thereby adding an additional expense.

Another problem with male type automotive fuses is that the fuse block contains a connecting piece, such as a double female clip, between the bus bar and the fuse blades. This extra component adds additional cost, increases the size of the product, and requires additional labor to assemble.

To overcome the problems of male fuses, female fuses have been developed. However, prior art female fuses must use extraordinary means and high cost plastics for the casing to withstand the heat generated by the melting of the fusible link.

A further problem has been to develop a small casing that is able to withstand the heat generally associated with the melting of the fusible link.

OBJECTS AND SUMMARY

It is an object of the present invention to provide a miniature female fuse that overcomes the problems of the prior art.

It is a further object of the present invention to provide a miniature female fuse having a fusible link comprised of a low melting temperature alloy so that excessive heat is not generated in the fuse body when the fusible link melts.

The present invention includes a female fuse, comprising a casing; a pair of clips inside said casing; and a fusible link electrically connecting said clips, said fusible link being constructed from a low melting temperature alloy.

DETAILED DESCRIPTION OF THE PREFERRED EMBODIMENTS

Figure 1:
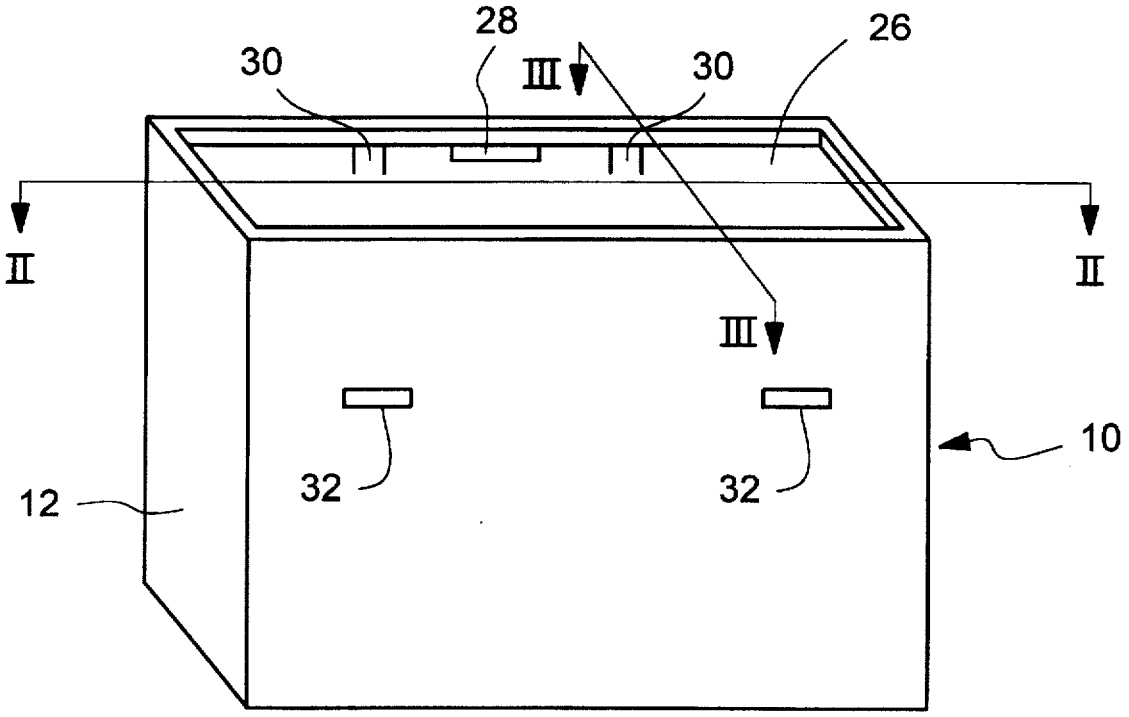
FIG. 1 is a perspective view of a fuse according to the present invention.
Figure 2:
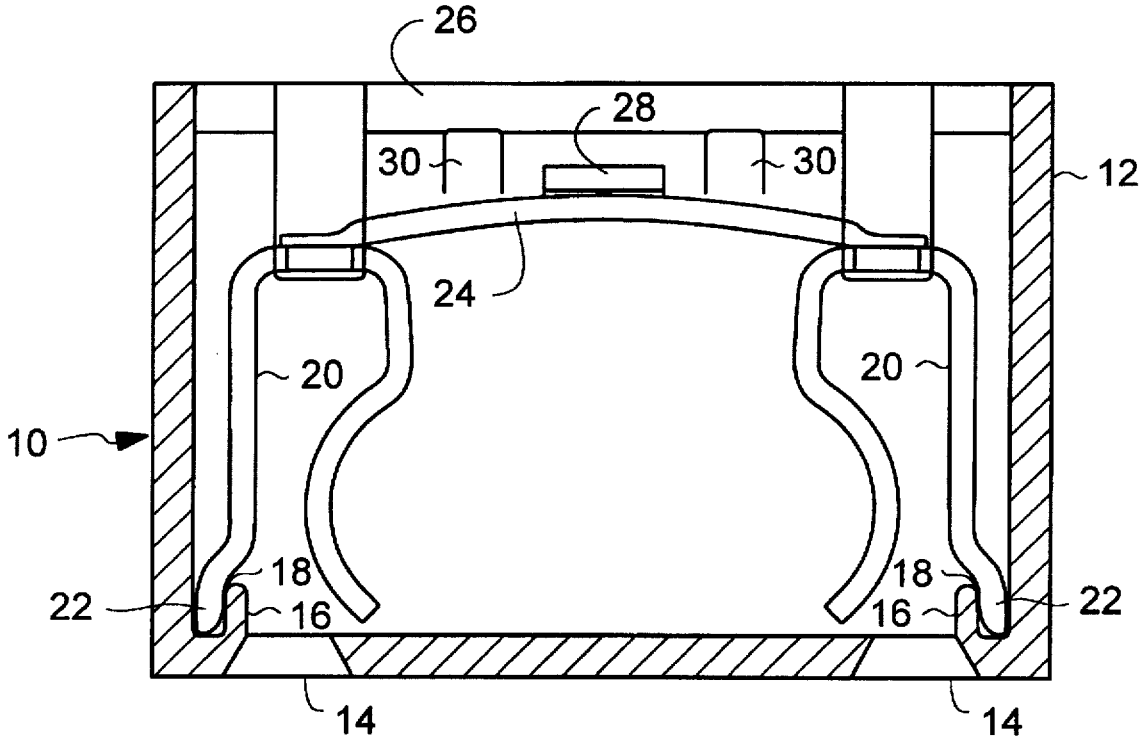
FIG. 2 is a cross-sectional view of a miniature female fuse taken along line II—II of FIG. 1.
Figure 3:
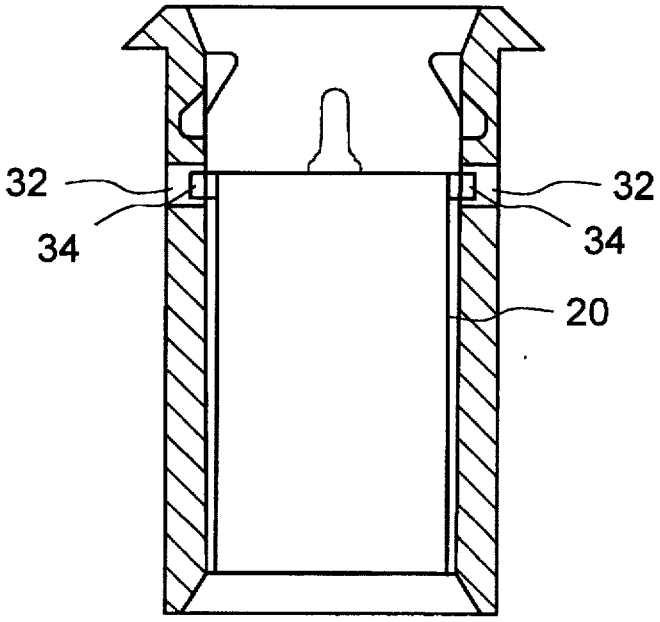
FIG. 3 is a cross-sectional view of a miniature female fuse taken along line III—III of FIG. 1.

Referring now to FIGS. 1–3, a female fuse 10 includes a casing 12. The casing is preferably made from a thermoplastic material. However, alternative materials, such as a thermosetting material may also be used. In a preferred embodiment, the dimensions of the casing 12 are about 7.3 mm×10.5 mm×3.5 mm.

The casing 12 includes two openings 14 through which connecting blades from a fuse box may be inserted.

The casing 12 further includes tabs 16 which form a groove 18 adjacent each opening.

One end 22 of a U-shaped clip 20 is retained in each groove 18 such that the U-shaped clip 20 is in alignment with the casing opening 14 so as to enable engagement with blades that are inserted into the casing 12.

A fusible link 24 is mounted between the two U-shaped clips 20.

A cover 26 is secured on the top side of the casing 12. Tabs 30 may be used to support the cover and an opening 28 may be provided to receive a projection from the cover 26 in order to lock the cover 26 in place on the casing 12.

The casing 12 may also be provided with side slits 32 that may receive lateral tabs 34 extending from the U-shaped clips 20. The lateral tabs 34 help locate the clips 20 within the casing 12 and trap the clips in casing 12.

As illustrated in FIG. 2, in a preferred embodiment of the fuse of the present invention, the two U-shaped clips 20 may be spaced 7.8 mm on centers. The depth of the U-shaped clips 20 is preferably 5.5 mm from an outside edge of the casing 12. However, other dimensions of the clips in the fuse body may be utilized depending upon the application.

The fusible link 24 may be connected to the clips 20 by resistance welding, or by using the parallel gap method. In addition, the fusible link 24 may be connected to the clips 20 by laser welding or by solder reflow.

Figure 4:
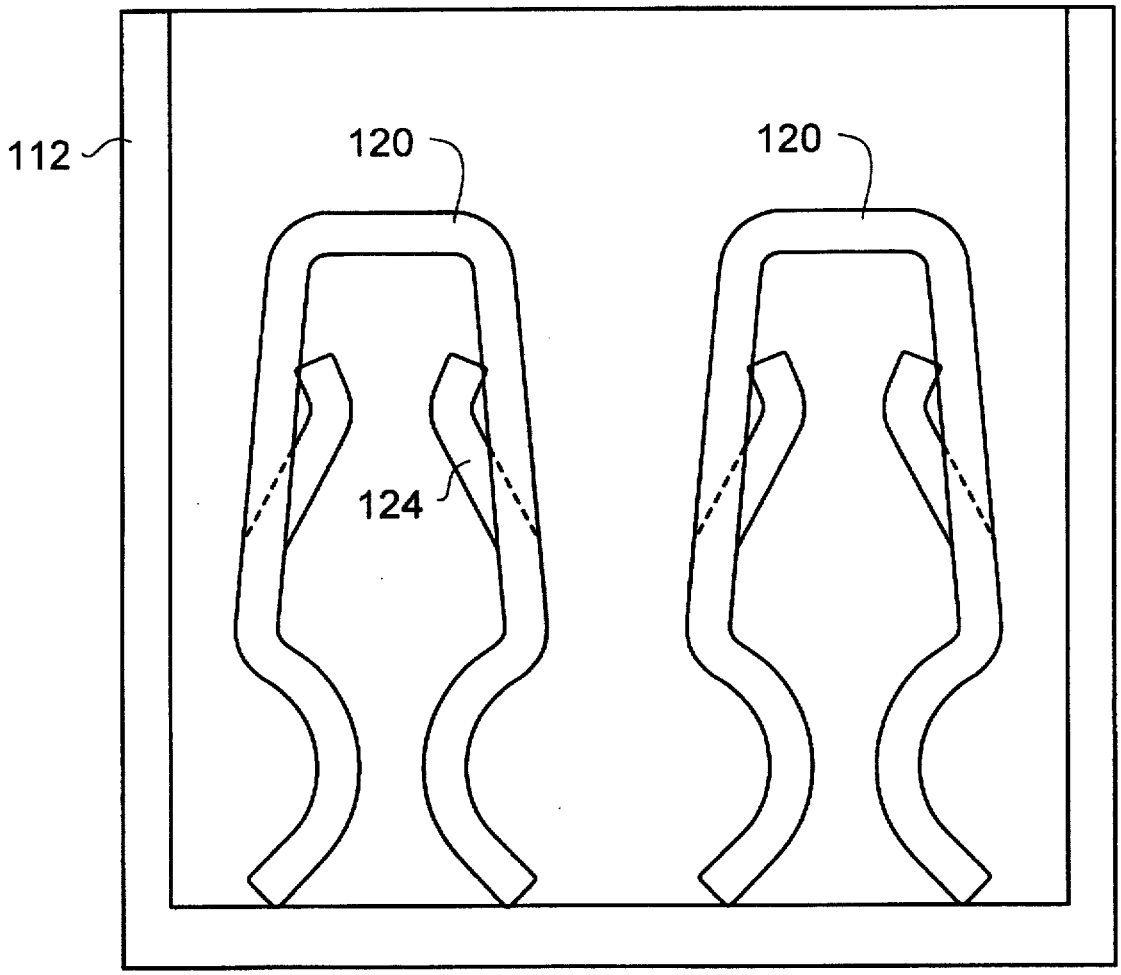
FIG. 4 is an alternative embodiment of the miniature female fuse of the present invention with different centerline spacing.

FIG. 4 illustrates an alternative embodiment of the present invention, wherein U-shaped clips 120 include projections 124 inside thereof in order to grasp the blade and reduce or prevent vibration. The projections 124 may be punched or lanced out from the sides of the U-shaped clips 120. In the particular embodiment illustrated in FIG. 3, the U-shaped clips 120 are spaced at 5.5 mm on centers, and the depth of the U-shaped clips is 9.0 mm. The entire casing 112 of the alternative embodiment is only 12 mm high. Although not specifically illustrated in FIG. 4, the casing 112 includes openings in alignment with the clips 120 and a cover. A fusible link connects the two clips.

In order to enable the fuse to function in such a small housing, special low melting temperature alloys are utilized for the fusible link 24.

The following table shows different materials that may be utilized for the fusible link 24 and the appropriate cross-sectional dimensions of the fusible link for the particular amp ratings set forth in the table.

| Amp Rating | Material | Size (mm) | Area ($mm^2$) |
|---|---|---|---|
| 1 | Pb(82)/Sb(18) | 0.25 × 0.1 | .025 |
| 2 | Pb(82)/Sb(18) | 0.5 × 0.2 | 0.1 |
| 3 | Pb(82)/Sb(18) | 1.5 × 0.15 | .225 |
| 4 | Sn(96.5)/Ag(3.5) | 0.9 × 0.2 | .18 |
| 5 | Sn(96.5)/Ag(3.5) | 1.4 × 0.2 | .28 |
| 7.5 | Sn(96.5)/Ag(3.5) | 1.6 × 0.4 | .64 |
| 10 | Sn(96.5)/Ag(3.5) | 1.5 × 0.75 | 1.125 |
| 12 | Au(80)/Sn(20) | 1.5 × 0.4 | .6 |
| 15 | Au(80)/Sn(20) | 1.5 × 0.6 | .9 |
| 20 | Au(80)/Sn(20) | 1.5 × 1.1 | 1.65 |

-continued

| Amp Rating | Material | Size (mm) | Area ($mm^2$) |
|---|---|---|---|
| 25 | Au(80)/Sn(20) | 1.8 dia | 2.54 |
| 30 | Au(80)/Sn(20) | 2.2 dia | 3.80 |

As published by CINDAS, the melt temperature of Pb(82)/Sb(18) is 252° C., the melt temperature of Sn(96.5)/Ag(3.5) is 221° C., and the melt temperature of Au(80)/Sn(20) is 278° C., all of which are known in the art.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A miniature female fuse, comprising:

a casing having a maximum dimension no greater than approximately 12 mm;

a pair of clips inside said casing; and a fusible link electrically connecting said clips, said fusible link being constructed from a low melting temperature alloy having a melt temperature no greater than approximately 278° C.

2. The fuse of claim 1, wherein the clips are spaced about 7.8 mm on centers.

3. The fuse of claim 2, wherein dimensions of the casing are about 7.3 mm×10.5 mm×3.5 mm.

4. The fuse of claim 1, wherein said casing is made from a thermoplastic material.

5. The fuse of claim 1, wherein the low melting temperature alloy is pb(82)/Sb(18).

6. The fuse of claim 1, wherein the low melting temperature alloy is Sn(96.5)/Ag(3.5).

7. The fuse of claim 1, wherein the low melting temperature alloy is Au(80)/Sn(20).

8. The fuse of claim 1, wherein the fusible link has a cross-sectional area in the range of 0.025 $mm^2$ to 3.80 $mm^2$.

9. The miniature female fuse of claim 1, wherein a rating of said fusible link is determined by a combination of a cross-sectional area of the fusible link and the low melting temperature alloy.

10. The miniature female fuse of claim 9, wherein the cross-sectional area of the fusible link is in the range of 0.18 $mm^2$ to 1.125 $mm^2$.

11. A miniature female fuse, comprising:

a casing having a maximum dimension no greater than approximately 12 mm;

a pair of U-shaped clips inside said casing; and a fusible link electrically connecting said clips, said fusible link having a cross-sectional area in the range of 0.025 $mm^2$ to 0.225 $mm^2$ and being constructed from Pb(82)/Sb(18) having a melt temperature of approximately 252° C.

12. The miniature female fuse of claim 11, wherein the low melting temperature alloy is Pb(82)/Sb(18).

13. A miniature female fuse, comprising:

a casing having a maximum dimension no greater than approximately 12 mm;

a pair of U-shaped clips inside said casing; and a fusible link electrically connecting said clips; said fusible link having a cross-sectional area in the range of 0.18 $mm^2$ to 1.125 $mm^2$ and being constructed from Sn(96.5)/Ag(3.5) having a melt temperature of approximately 221° C.

14. The miniature female fuse of claim 13, wherein the cross-sectional area is the range of 0.025 $mm^2$ to 0.225 $mm^2$.

15. The miniature female fuse of claim 14, wherein the low melting temperature alloy is Pb(82)/Sb(18).

* * * * *